United States Patent [19]

Holmes

[11] Patent Number: 4,921,104

[45] Date of Patent: May 1, 1990

[54] PACKAGE WITH RECLOSABLE POURING SPOUT

[75] Inventor: Gordon W. Holmes, Toronto, Canada

[73] Assignee: Professional Packaging Limited, Mississauga, Canada

[21] Appl. No.: 309,139

[22] Filed: Feb. 13, 1989

[30] Foreign Application Priority Data

Feb. 12, 1988 [GB] United Kingdom ..... 8803290

[51] Int. Cl.[5] ..... B65D 17/28

[52] U.S. Cl. ..... 206/621.4

[58] Field of Search ..... 206/621.3, 621.4, 621.5, 206/621.6, 631.2, 633

[56] References Cited

U.S. PATENT DOCUMENTS

| | | | |
|---|---|---|---|
| 807,418 | 12/1905 | Cavanagh | 206/621.5 |
| 2,332,153 | 2/1941 | Levin . | |
| 2,362,612 | 1/1968 | Mohler | 206/621.6 |
| 2,362,942 | 11/1944 | Spalding | 206/621.5 |
| 2,593,778 | 4/1952 | McGinnis | 206/621.3 |
| 2,610,770 | 7/1946 | Penfield . | |
| 2,701,679 | 10/1952 | Goldstein . | |
| 3,155,306 | 11/1964 | Moore | 206/621.3 |
| 3,289,913 | 2/1965 | Svensson . | |
| 3,335,922 | 7/1965 | Leff . | |
| 3,344,972 | 11/1965 | Robinson et al. . | |
| 3,568,911 | 1/1969 | Bebout . | |
| 3,570,743 | 4/1969 | Mohler . | |
| 3,982,683 | 9/1976 | Forteau | 206/621.3 |
| 4,054,240 | 10/1976 | LaPierre . | |
| 4,194,677 | 6/1978 | Wysocki . | |
| 4,569,443 | 2/1986 | Roccaforte | 206/621.3 |

FOREIGN PATENT DOCUMENTS

| | | | |
|---|---|---|---|
| 0569629 | 5/1974 | Switzerland | 206/621.4 |
| 1275802 | 5/1972 | United Kingdom | 206/621.6 |

*Primary Examiner*—Stephen P. Garbe

*Attorney, Agent, or Firm*—Sim & McBurney

[57] ABSTRACT

A novel carton structure useful for a variety of pourable products and having an integral pouring spout is described. The carton is formed by conventional blank die cutting, gluing, forming and filling. When first constructed, a secure integral enclosure is provided. The carton is readily opened and the spout formed by tearing along pre-formed lines of perforation specifically located for the purpose. Once the carton has been opened, product may be poured full-width from the carbon via the spout. The construction of the spout permits opening to a controlled extent, reclosure to a friction-locked enclosure and guided movement between the two.

12 Claims, 13 Drawing Sheets

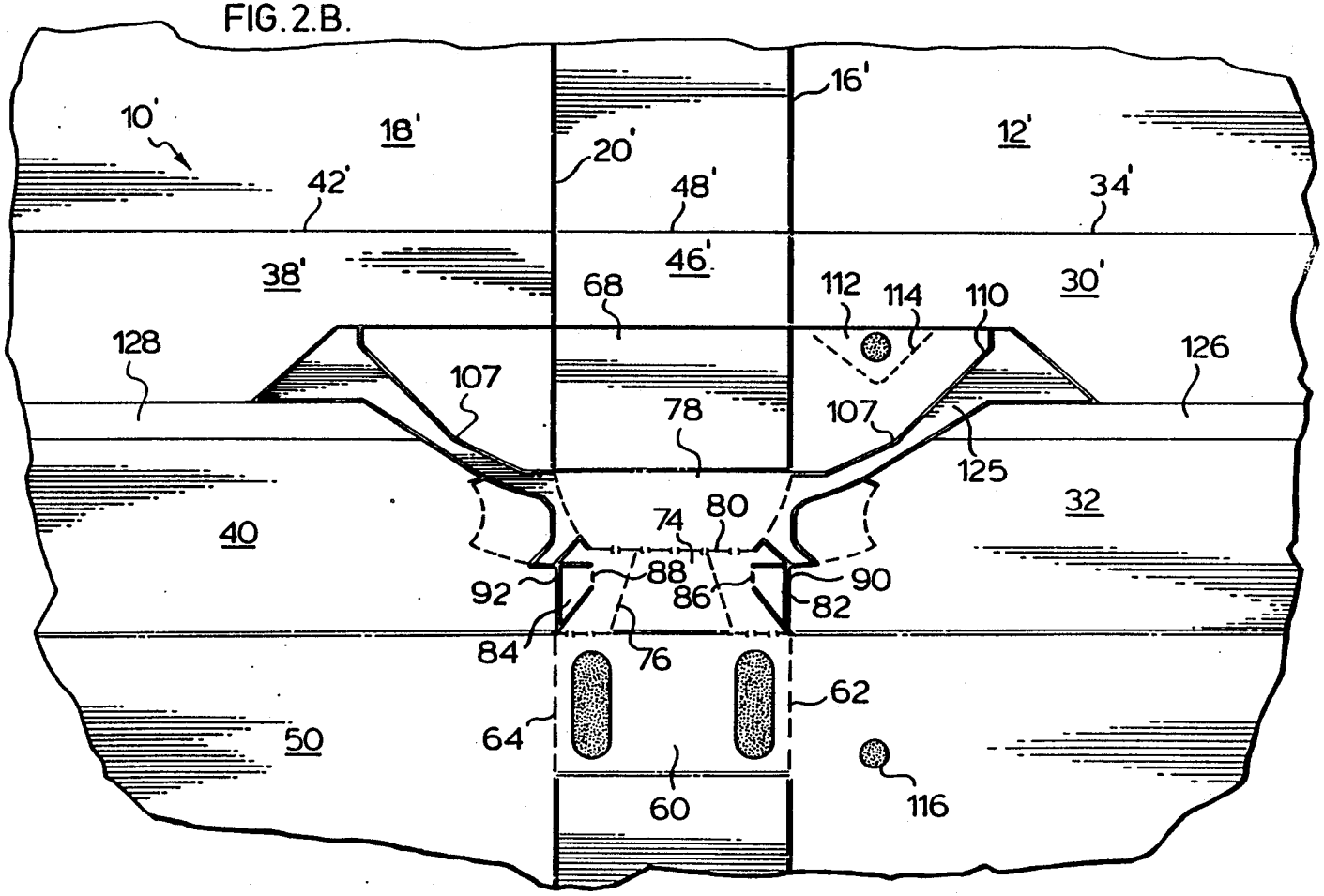
FIG. 2.B.

FIG. 7B.
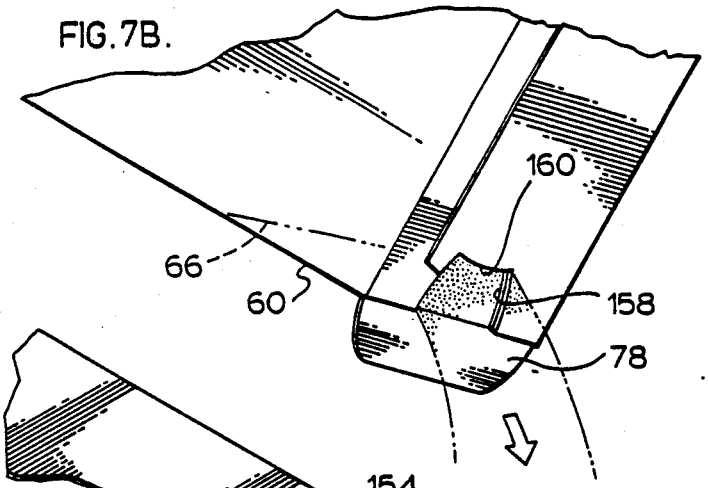
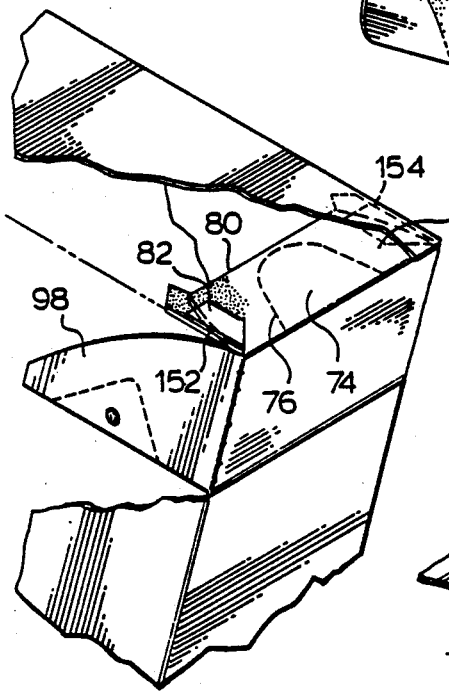
FIG. 9B.
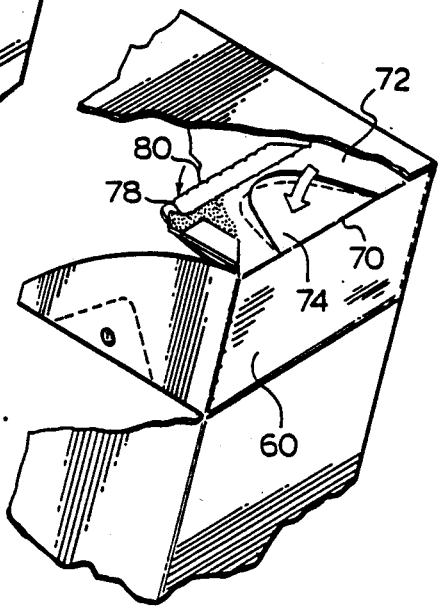
FIG. 9C.

PACKAGE WITH RECLOSABLE POURING SPOUT

FIELD OF INVENTION

The present invention relates to packaging materials, in particular to packages of flowable materials having a reclosable pouring spout.

BACKGROUND TO THE INVENTION

For many years in the packaging industry, there has been a need for an inexpensive, reclosable pouring spout. On many product lines it is common practice to include a separate metal pouring spout as a means of providing the desired convenience for the user and the added protection for the product. However, such metal pouring spouts are included only at considerable additional expense.

There are many products, however, whose pricing structure simply does not allow for the luxury of the metal spout and many others where this concept is not suitable or practical.

In addition to its high cost, the metal pouring spout has other design weaknesses The major ones are as follows (a) All too often the spout rips off or falls off, depending on how rough the usage or how well it may be anchored to the package.

(b) Sometimes if the spout is closed too vigorously it becomes "submerged" or locked inside the package and is very difficult to dislodge without virtual destruction.

(c) The metal "sides" of the spout sometimes become dislodged from the die-cut opening, necessitating the nuisance of re-insertion.

(d) In attempting to re-install or repair the closure, the consumer runs the risk of a lacerated finger.

(e) Clogging of many products in the "spout" is also a problem.

(f) Some consumers are frustrated by the fact that residual product is often trapped in the upper corners of the box because of the location of the metal pouring spout.

(g) It is of major concern that the metal spout precludes the use of electronic metal detectors in the final inspection of the filled product on the production line.

The alternatives to the system described above are perforated tabs that are pressed in or corners that are ripped or sawn open with the family bread knife. Numerous attempts have been made to have reclosable flaps, but in most cases the product sits in the kitchen cupboard or laundry room with the upper corner of the package gaping open and the product dangerously exposed.

This type of packaging produces many health hazards, and much aggravation and inconvenience for the consumer. Most of these problems and hazards are well known and serve to emphasize the need for a proper reclosable package that is affordable by the manufacturer and functional for the consumer.

Most, if not all, of the products in question, are poured out into a bowl or measuring cup and a low cost, functional, reclosable pouring spout would be a considerable asset for product protection and consumer convenience.

The present invention provides a novel paperboard packaging structure in which the pouring spout, located in the corner of the carton, is integrally formed out of the material of construction of the package thereby considerably improving the economics and also providing a more functional reclosable spout.

A search has been conducted in the facilities of the U.S. Patent and Trademark Office with respect to the subject matter of this invention, specifically in class 206, subclasses 621.4 and 621.6. The following U.S. patents located in such search were considered the closest prior art to the invention:

| | |
|---|---|
| 4,194,677 | 3,335,922 |
| 4,054,240 | 3,289,913 |
| 3,570,743 | 2,701,679 |
| 3,568,911 | 2,610,770 |
| 3,344,972 | 2,332,153 |

Some of these prior art references describe structures which are impractical to manufacture and fill with modern equipment for carton manufacture in the boxmaker company plant and high speed filling and sealing lines in the user company plant.

U.S. Pat. No. 3,335,922 teaches the provision of a pouring spout which is manufactured separately and glued in place along two glue laps. Not only does the die-cut spout have to be folded for gluing into position, but one of the narrow glue laps also has to be folded over a full 180°, necessitating a manual operation.

U.S. Pat. No. 3,289,913 describes a somewhat impractical design. Cartons of the type in question must be preglued by the carton manufacturer and then filled and sealed by the user. The patentee suggests that the user will do the gluing. In any event, the design illustrated is impossible to manufacture and glue. Panel 18 is the traditional standard glue lap, but glue applied to it also would be deposited on spout panel 42. No provision is made to prevent product sifting through all four corners of the box. This reference also suggests that by interdigitating one blank into the one above results in the use of no extra paperboard. This suggestion is incorrect, as is evident from the top row of cartons seen in FIG. 1.

U.S. Pat. No. 2,610,770 also describes a somewhat impractical structure. This reference describes a preformed measuring trough that opens and closes in spout fashion to provide a measured amount of product each time. The arrangement is such that the carton manufacturer cannot preglue the measuring spout into the carton, otherwise it could not ship flat, and would need to be formed and glued on the filling line. To do so is impossible.

U.S. Pat. No. 2,332,153 describes a simple pouring spout made from a separate piece of paperboard and bonded to the inside end wall of an end-seal carton. The ability to locate and glue a separate piece with accuracy is limited and difficult to achieve at high speed. The pouring spout is required to be opened with a knife, which is a safety hazard and a liability concern. It relies on shaking of the box to open the spout, which inevitably would result in product being ejected from the box as the spout opens.

SUMMARY OF INVENTION

In accordance with the present invention, there is provided a novel carton structure for a wide variety of pourable materials and products, usually powdered or granular in nature, having a reclosable integral pouring spout which does not suffer from the draw-backs of the prior art and which is capable of being manufactured consistently at high speed on modern, state-of-the-art fully automated carton production equipment, with minimum of paperboard material.

The novel carton structure is formed from blanks of paperboard material which are die-cut, folded and glued and then erected and filled, all by conventional modern equipment. When the package is filled for shipment by the manufacturer to a retailer, who then sells it to the consumer, the carton is secure and is not subject to accidental or other unintentional opening. The whole carton structure is formed of the same material of construction and eliminates the necessity for additional metal or plastic pouring spouts.

The carton is readily opened by the consumer and the spout then is formed at that time by tearing along specifically located severable score or perforation lines. When the spout is formed in this way, the spout is able to be opened and closed as needed for convenient pouring out of the product.

Accordingly, in one aspect of the present invention, there is provided an improvement in a carton constructed of paperboard .material, and housing a pourable product to be dispensed therefrom through a pouring spout. The improvement is in the unique construction of the pouring spout.

The pouring spout is defined by a plurality of panels of the paperboard material. A first rectangular panel of double thickness is joined to a side panel of the carton by a first fold line extending transversely across the side panel and is dimensioned to fill a rectangular opening in the side panel adjacent an upper end thereof and through which the product is poured.

A first wing panel is joined to one side edge of the first rectangular panel by a second fold line and a second wing panel is joined to the other side edge of the first rectangular panel by a third fold line. Each wing panel extends substantially at right angles to the first rectangular panel into the opening to define first and second side walls of the pouring spout for the entire extent of the opening of the spout to a fully-opened position by folding about the first fold line.

A tab panel is joined to an upper edge of the first rectangular panel by a fourth fold line and is arranged to be bent between a first position in which the tab panel extends approximately at right angles to first rectangular panel for entry into the opening when the pouring spout is closed and a second position in which the tab panel permits product to flow over the surface thereof during pouring of the product from the carton.

As used herein, the term "paperboard" refers to relatively-stiff materials of construction normally employed for making cartons intended to house and dispense flowable products and which can be easily folded about fold lines. The term includes folding boxboard material and corrugated paperboard.

The carton of the present invention is useful for dispensing a wide variety of products, for example:

1. Detergents (laundry and dishes)
2. Household cleaners
3. Bleaches
4. Washing soda
5. Industrial chemicals
6. Starch
7. Wallpaper paste and adhesives
8. Patching plaster
9. Wide range of baby cereals
10. Rolled oats and other cookable breakfast cereals
11. Dry breakfast cereals
12. Dehydrated milk powders
13. Salt and other condiments
14. Granulated and powdered sugar
15. Instant rice and barley
16. Baking powder and soda
17. Bird Seed
18. Wide range of dry pet foods
19. Fertilizers
20. Insecticides and Pesticides In another aspect of the present invention, there is provided an improvement in a carton constructed of paperboard material and having a product in multiple numbers of discrete packages .to be dispensed therefrom through a spout or trough. The product concerned usually is in the form of small unit servings, such as tea bags, pouch packs for sugar and sugar substitutes, drug sundries and confections. The improvement is in the construction of the spout. In contrast to the first aspect of the invention where the pouring spout is located in the upper region of a side wall of the carton, in this aspect of the invention, the spout is provided in the lower region of a side wall of the carton.

The spout is defined by a first rectangular panel joined to a bottom panel of the carton by a first fold line and dimensioned to fill a rectangular opening in a side panel adjacent the lower end thereof through which the discrete packages are dispensed.

A first wing panel is joined to one side edge of the first rectangular panel by a second fold line. A second wing panel is joined to another side edge of the first rectangular panel by a third fold line.

Each of the wing panels extends substantially at right angles to the first rectangular panel into the opening to define first and second side walls of the spout for the entire extent of opening of the spout to a fully opened position by folding about the first fold line.

The structure of the pouring spout provided in the present invention differs significantly from the prior art discussed above. For example, in U.S. Pat. No. 3,289,913 two arc-shaped panels are joined to a main panel and a skirt is added to each wing of the spout. U.S. Pat. No. 2,332,153 describes a similar arrangement of an arcuate wing but with no skirt. The pouring spout in the present invention uses two wing of unique design with three special elements and no skirt function. In this regard, the spout has a distinct hump feature to provide a friction lock as the pouring spout is reclosed, an arcuate zone is provided carefully contoured to travel in the unique track feature and a distinct flat area is provided to engage the inside-top area of the carton to prevent the spout from pulling all the way out. Each spout also has arcuate pull tab attached to the upper edge which assists considerably with swift trouble-free re-opening of the pouring spout and may act as a snap-lock feature seldom-used product, such as pancake mix, icing sugar and patching plaster, to effect closure between uses.

BRIEF DESCRIPTION OF DRAWINGS

FIG. 2B is a plan view of the same portion as FIG. 2A but for a modified form of the carton blank;

FIGS. 7A and 7B are perspective views of the carton with the spout in the pouring position for unrestricted flow and for restricted flow;

FIG. 9A is a sectional view of the spout while FIGS. 9B, 9C, 9D and 9E are detail cut-away views of the spout;

DESCRIPTION OF PREFERRED EMBODIMENTS

Figure 1:
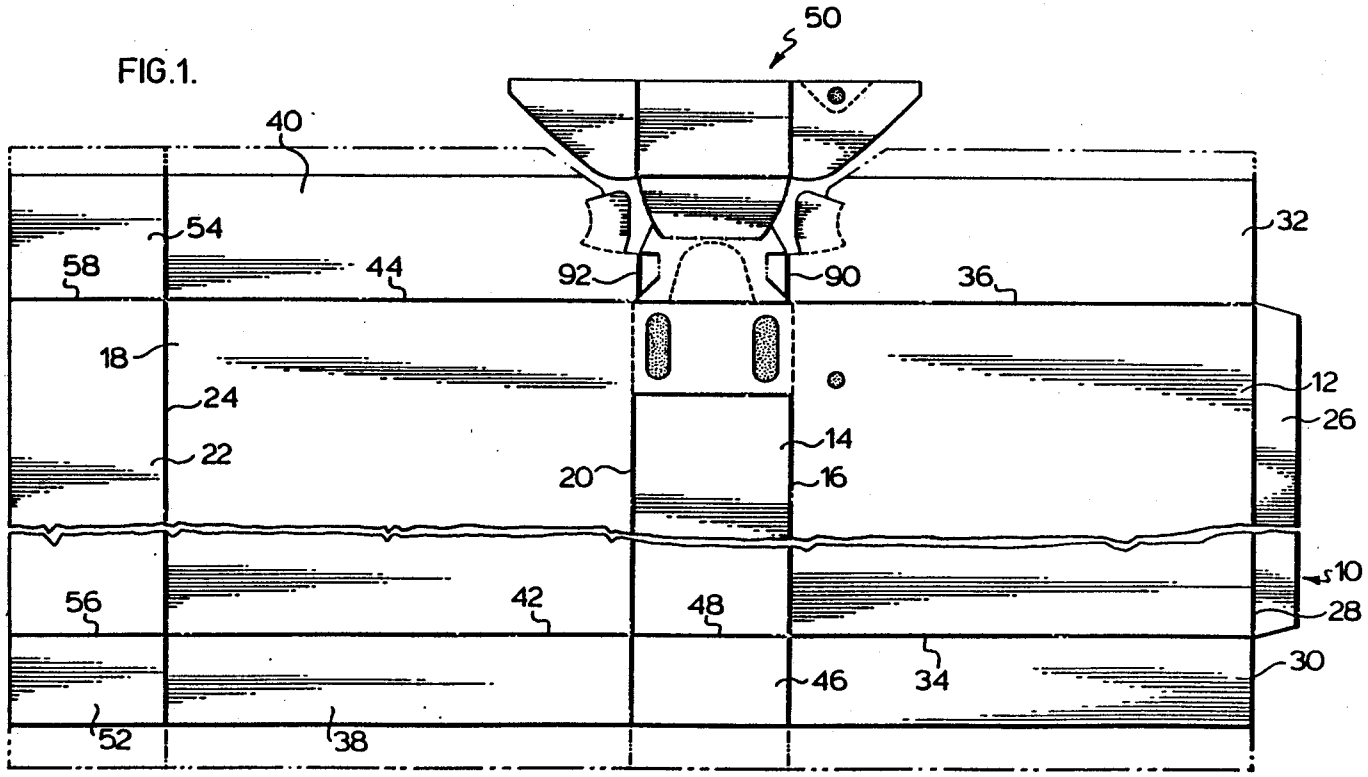
FIG. 1 is a plan view of a blank for a carton provided in accordance with one embodiment of the invention.

Referring to the drawings, FIGS. 1 to 9D, 12 and 13A 13B illustrate one embodiment of the invention. FIG. 1 shows an integral carton blank 10 constructed of paperboard, cardboard or other convenient material having a first rectangular panel 12 joined to a second rectangular panel 14 at a fold line 16. The second rectangular panel 14 is joined to a third rectangular panel 18 at a fold line 20. The third rectangular panel 18 is joined to a fourth rectangular panel 22 at a fold line 24.

The rectangular panels 12 and 18 have the same dimensions and form the front and rear panels of the carton while rectangular panels 14 and 22 have the same dimensions and form side panels of the carton. The rectangular panel 12 is joined to a lap panel 26 at a fold line 28, which is intended to be glued to rectangular panel 22 to form the carton.

The rectangular panel 12 also is joined to rectangular end panels 30, 32 at fold lines 34, 36 respectively. The rectangular panel 18 similarly also is joined to rectangular end panels 38, 40 at fold lines 42, 44. The rectangular panel 14 is joined to a rectangular end panel 46 at fold line 48 and is provided with a particularly constructed panel 50 at the other end, described in more detail below and providing the reclosable spout structure. The rectangular panel 22 is joined to rectangular end panels 52, 54 at fold lines 56, 58 respectively.

The panels 30, 38, 46 and 52 overlap, are suitably glued to each other and cooperate to form a bottom end closure to the carton, while panels 32, 40, 50 and 54 overlap, are suitably glued to each other and cooperate to form a top end closure to the carton. The panels forming the top and bottom closures may be sized to overlap completely (dotted outline) or partially, typically a ¾ overlap (solid line), as is known in the art.

Figure 2A:
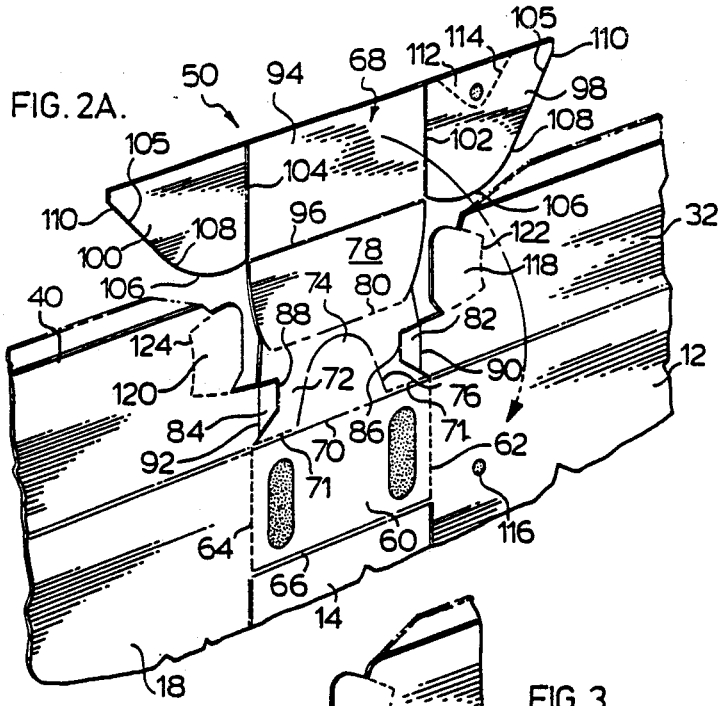
FIG. 2A is a perspective view of a portion of the blank of FIG. 1 showing the elements forming the reclosable pouring spout.
Figure 3:
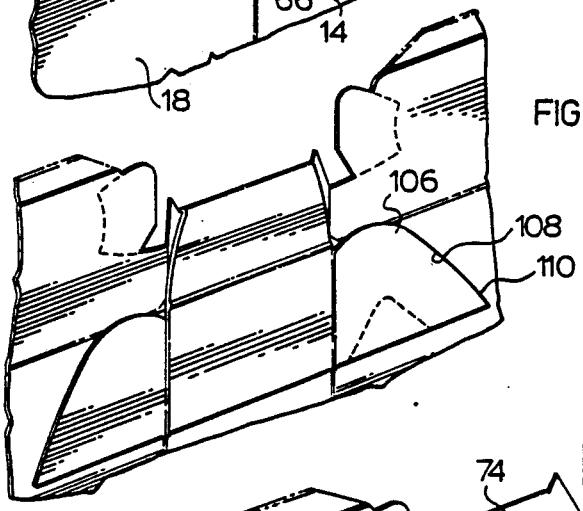
FIG. 3 is a perspective view similar to FIG. 2A showing flaps folded over on one another.
Figure 4:
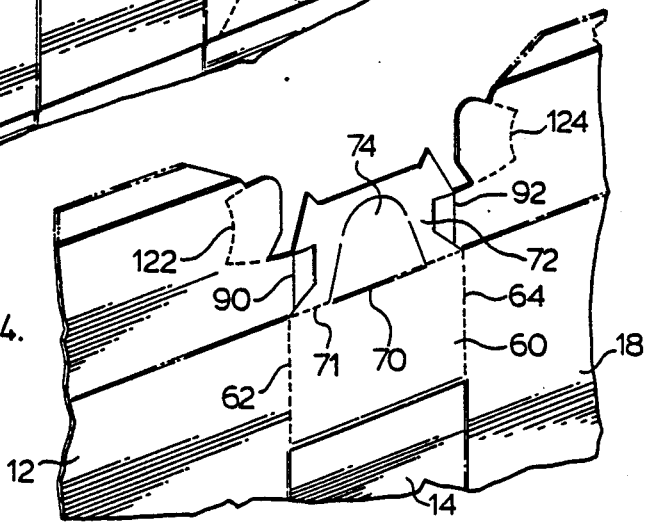
FIG. 4 is a perspective view of the opposite side of FIG. 3.
Figure 5A:
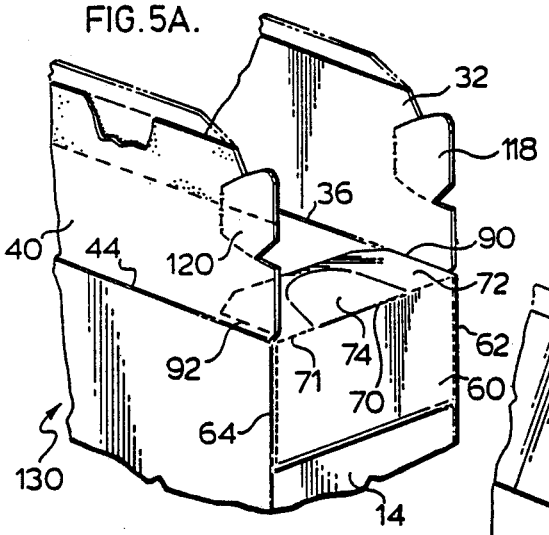
FIGS. 5A and 5B show folding of the top panel of the carton to form the closure.
Figure 5B:
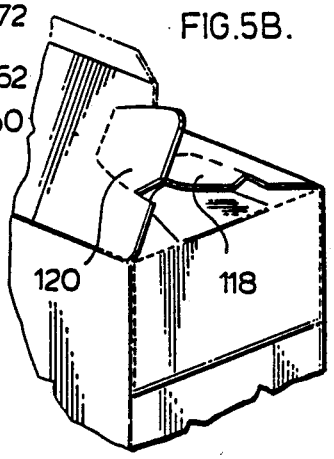
Figure 6A:
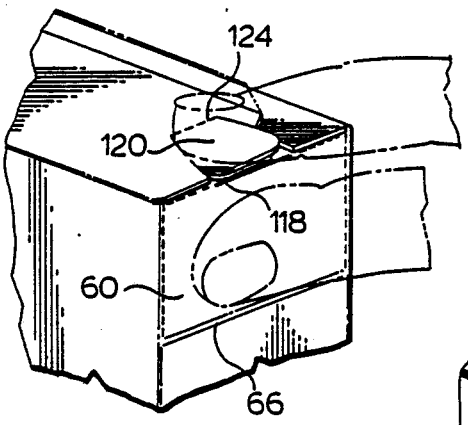
FIGS. 6A, 6B and 6C show the sequence of steps for the consumer to open the carton.
Figure 6B:
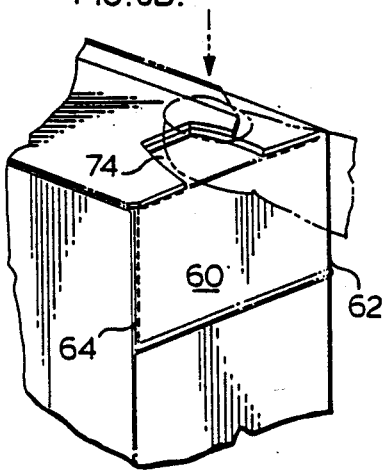
Figure 6C:
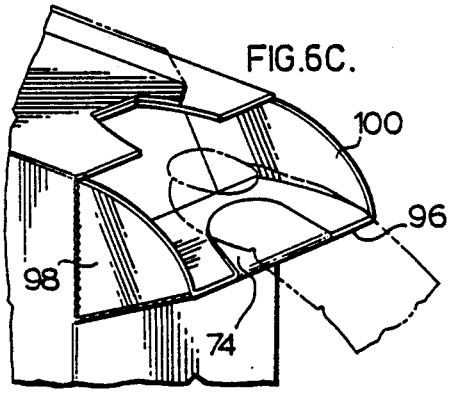

The panel 50 as well as cooperating parts of adjacent panels 32, 40 provide an openable and reclosable pouring spout in accordance with the invention and is particularly shown in FIGS. 2A, 3 and 4. A modified form of the panel 50 is shown in FIG. 2B, although the same reference numerals are employed to designate the same parts.

The panel 50 includes a first panel portion 60 which is joined to the panels 12 and 18 at perforated lines 62, 64, which, as will be seen from the later description, permit the carton to be opened manually. The panel portion 60 also is joined to the panel 14 at a fold line 66 and to a flap element 68 at a fold line 70, which is partially perforated at 71.

The flap element 68 comprises a panel 72 in which is formed a tab 74 joined to the panel 72 at a score line 76. A panel 78 is joined to the panel 72 at a perforated and partly-cut line 80.

The panel 72 also has tabs 82, 84 joined by crease lines 86, 88 respectively. As may be most clearly seen in FIG. 1, the cut lines 90, 92 between the tab 82 and panel 32 and between the tab 84 and the panel 40 respectively are inwardly offset to a small extent (approximately 1/16 inch) from alignment with perforated lines 62 and 64 respectively, for reasons which will become apparent below.

The flap element 68 also includes a rectangular panel 94 which is joined to panel 78 at a fold line 96 and is dimensioned the same as panel 60. The rectangular panel 94 is joined to two wing panels 98, 100 of mirror-image shape at fold lines 102, 104. The wing panels have a specifically-designed contour 105, which includes a hump-like portion 106, a curved portion 108 and a flat portion 110. The purpose of the contouring will become apparent below. As may be seen, the contouring is slightly different in the embodiment of FIG. 2B.

A tab 112 formed in the wing panel 98 has a perforated contour line 114 and is adhesively bonded to the panel 12 at a glue spot 116 when the flap element 68 is folded about fold line 80. Adhesively bonding the wing panel 98 to the panel 12 in this manner ensures that the folded over flap element 68 lies flat during assembly and filling of the carton, while the perforated line 114 permits the element 68 to be released upon opening of the carton.

The panels 32 and 40 are cut-away in the region of the flap element 68 to define tabs 118, 120 which are joined to the respective panels by perforated lines 122, 124.

In FIG. 2B, there is illustrated the relative locations of the elements of a blank 10 and the next adjacent blank 10′ on a high speed die cutting machine, wherein the panels identified for blank 10′ are identified by prime numerals although the structure of the flap element 68 in the embodiment of FIG. 2B is different from that in FIG. 2A, the same principles with respect to the relative locations of the blank 10 to the next adjacent blank $10^1$ applies. As may be seen, in FIG. 2B a small amount of material is cut away at 125 and may be removed by an autostripping device and only a minor amount of waste occurs, in regions 126, 128. It is a full overlap of end panels is desired, the resulting waste regions are decreased. The blank 10 is readily formed and glue applied using modern conventional die-cutting and gluing procedures.

At the gluing stage in the carton company plant, the flap element 50 is folded and glued at high speed about fold line 80 and the wing panel 98 is adhesively joined to the panel 12 at glue spot 116. The normal carton glue lap 26 is automatically glued at the same time. In this way, each carton blank, folded and glued, has the pouring spout fully assembled and glued in position by the boxmaker. Erection of the carton, filling and sealing both top and bottom glue laps, is effected by the user company.

At the plant of the packager, the preformed cartons are opened and filled in the normal way. The cartons are erected and glued in conventional manner to provide a carton with end seals top and bottom and with the integral, reclosable pouring spout already incorporated into the upper corner of the carton 130. On the conventional high speed filling line, the flowable material is loaded into the carton as the bottom and top of the carton are automatically sealed on the same filling line.

This latter operation is effected by folding the flap 72 inwardly about fold line 70 and the panel 46 about fold line 48 to lie at right angles to the end panel 14. Panels 32 and 40 then are folded successively about their fold lines 36 and 44 to engage and be glued to the folded-over panels 72 and 46 (see FIGS. 5A and 5B).

Figure 12:
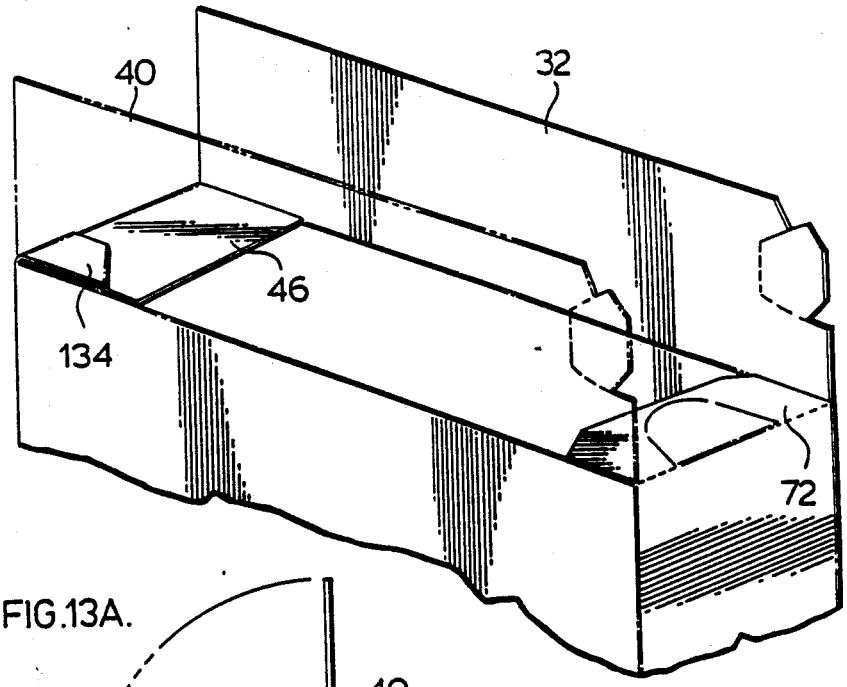
FIG. 12 is a perspective view of the top closure panel of a modified form of the structure of FIGS. 1 to 9.
Figure 13A:
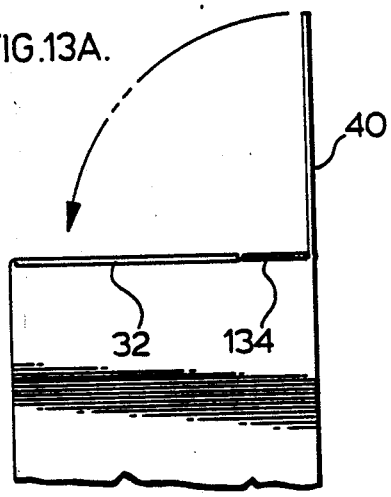
FIGS. 13A and 13B show assembly of the top closure panel.
Figure 13B:
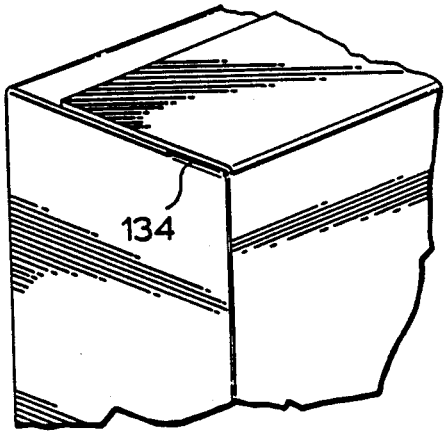

For the panel 72, the overlying portions of panels 32 and 46 are adhesively-joined to it in the regions outside the periphery of the tab 74. To assist in ensuring an effective and sift-proof seal between the overlying panels 32 and 46, flap 46 may be provided with an embossing 134 in the non-overlapping regions, as seen in FIG. 12 and 13. A similar arrangement may be made for the overlapping lower panels at both corners.

While the upper and lower closures to the carton 130 are shown as formed by an approximately three-quarter overlap between the respective pairs of panels 32 and 40 and 30 and 38, fully-overlapping panels may be employed, if desired, as is well known in the packaging industry (see dotted outline in FIGS. 1, 5 and 6).

Figure 10:
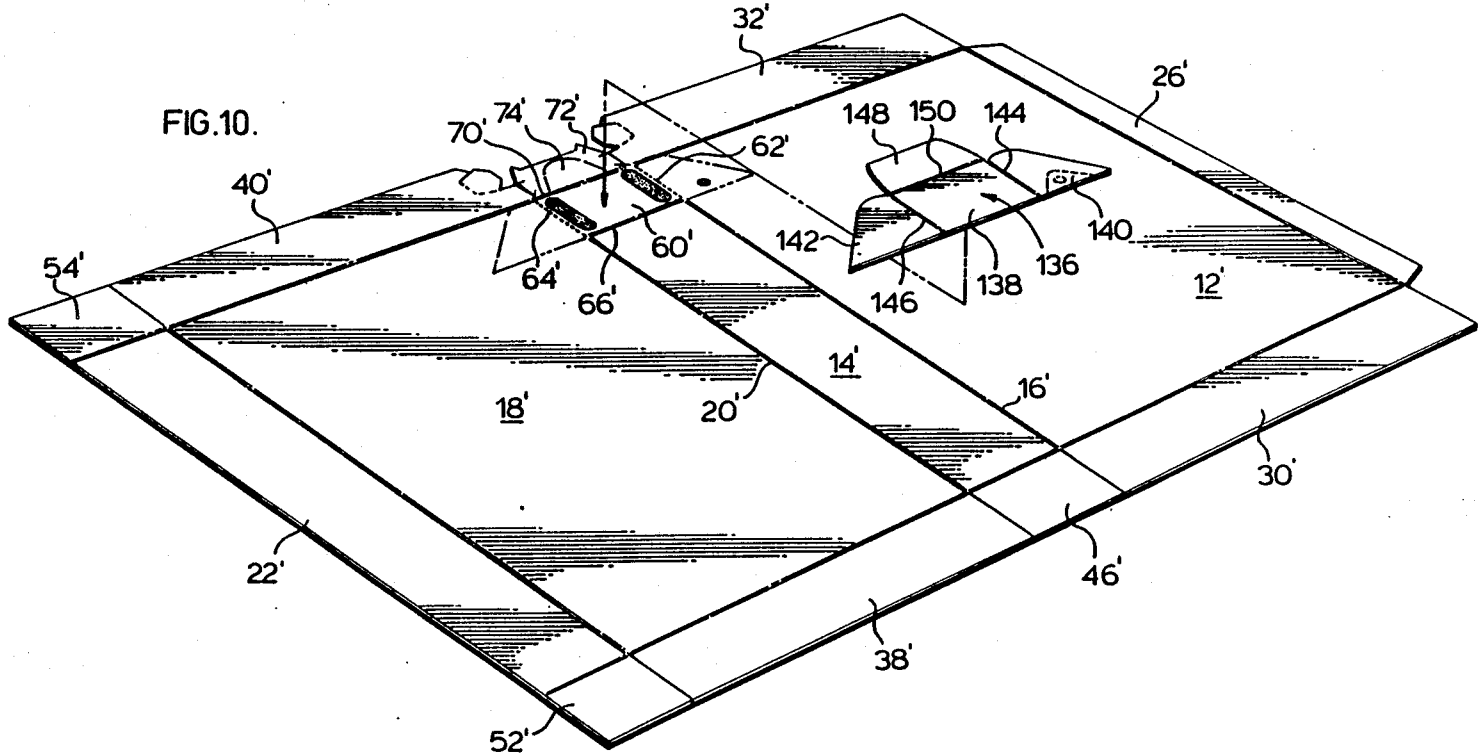
FIG. 10 is a perspective view of a blank for a carton provided in accordance with another embodiment of the invention.
Figure 11:
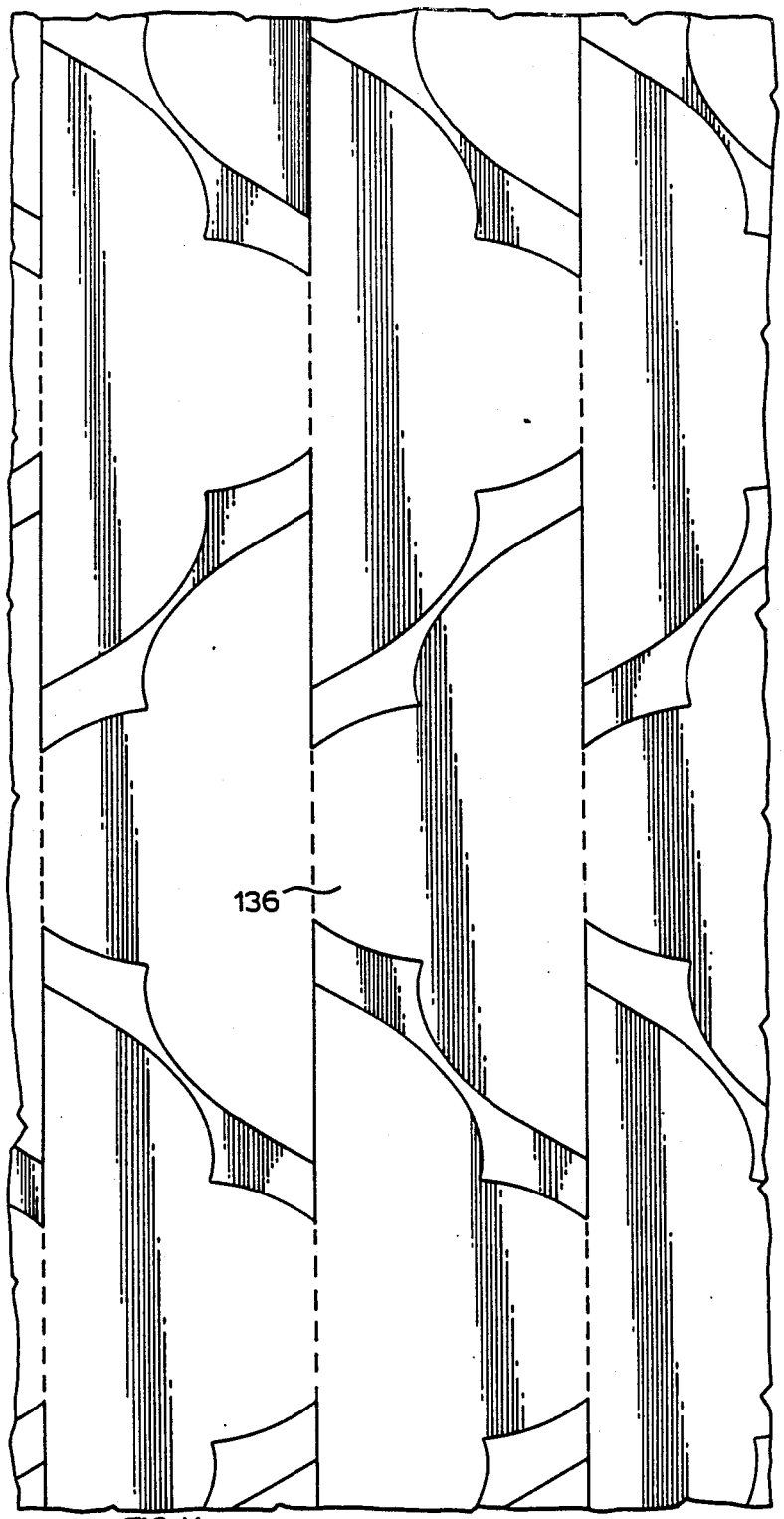
FIG. 11 is a plan view of a die-cut layout to produce a number of die-cut pieces for use with the blank of FIG. 10 with a minimum of wastage of material.

In the embodiment illustrated in FIGS. 1 to 9, the pouring spout is formed from an integrally-formed blank. As illustrated in FIGS. 10 and 11, a separate die-cut element 136 may be employed in association with a blank 10'.

In FIG. 10, prime reference numerals have been employed to designate the same panel as designated by that reference numeral in FIG. 10. Die-cut element 136 comprises a central panel 138, equivalent to panel 94 in FIG. 1, to which are connected a pair of wing panels 140, 142 through fold lines 144, 146, contoured as described above for panels 98, 100 respectively. A further panel 148, equivalent to panel 78, is connected to the central panel 138 through fold line 150.

The die-cut element 136 may be cut in multiple numbers from a sheet of cardboard on a conventional die-cutting machine, in any convenient pattern. One pattern providing for die-cutting a multiple number of such elements with a minimum of waste is shown in FIG. 11. The finished component can be supplied in cartridge form or in continuous rolls ready for application.

The die-cut element is adhesively bonded to the blank 10, with panel 138 overlying and bonded to panel 60' and panel 148 overlying panel 72', which is analogous to folding of flap element 68 about fold line 80 in the FIG. 1 embodiment.

With the carton 130 (FIG. 7) formed, filled and sealed, an integral container is provided from which product cannot exit or become contaminated from the exterior. Access to the product in the carton 130 may be had in the manner illustrated in FIGS. 6A, 6B and 6C and FIGS. 9B to 9E.

When the carton 130 is in a fully closed and sealed position, the tabs 118, 120 overly one another and the panel 72. By virtue of the edges 90 and 92 of panel 72 being spaced inwardly from the adjacent front and rear panels 18 and 12, a "track" in 152, 154 is provided which receives the contoured periphery of the respective wing panels 98, 100 and guides those panels during opening and closing of the spout.

As seen in FIGS. 6A to 6C and 9B (See FIG. 9A) to 9E, the overlying tabs 118, 120, which are bonded to each other but not to the underlying tab 74, are removed by tearing about perforations 122, 124 and are discarded.

The tab 74 then is pushed down to detach it from the panel 72 at the perforations 76, leaving the remainder of the panel 72 adhered to the overlying portions of panels 32 and 40. At the same time, downward pressure on tab 74 detaches the underlying panel 78 from the panel 72 at the perforations 80. The tab 74 then is bent downwardly about fold line 70 along with panel 78 until it lies adjacent the rear of panel 60.

The combined tab 74, panel 78 and panel 60 then are pulled away from the carton, causing the panel 60 to become detached from the panel 72 at the perforations 71 and from the front and rear panels 12 and 18 at the perforations 62 and 64, so that the panel 60 is able to bend outwardly about fold line 66. At the same time, the wing panel 98 becomes detached from panel 12 by breaking of perforations 114, leaving tabs 112 attached to the panel 12.

The wing panels 98 and 100 ride in the tracks 152 and 154. A limit to the extent of such outward bending is provided by engagement between the flat portions 110 of the contoured peripheries 105 of the wing panels 98 and 100 and the underside of the top panels 32 and 40 in the tracks 152 and 154. When or before such limit, the flap 78 and tab 72 may be folded out about fold lines 70 and 96 to provide a guide flap 78. A further hump-like portion 107 (see FIG. 2B) may be provided to the contoured periphery between the curved portions 108 and the flat portions 110 to provide a friction lock for the spout in its fully open position. A snug fitting spout, however, with careful attention to tolerances, seems to function best.

Figure 7A:
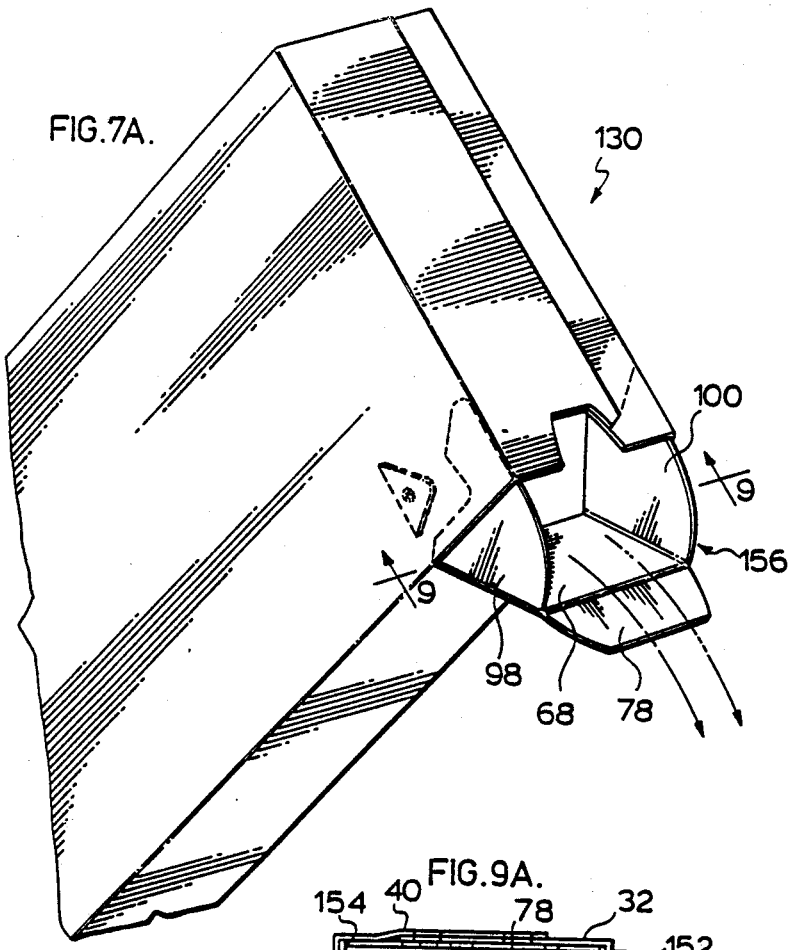
Figure 9A:
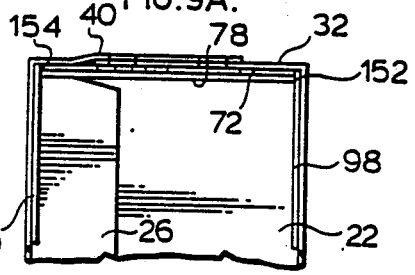
Figure 8A:
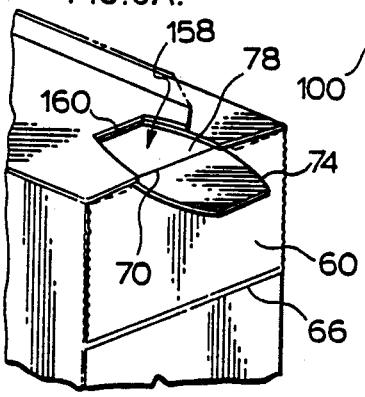
FIGS. 8A and 8B are detailed perspective views of the spout after reclosure.
Figure 8B:
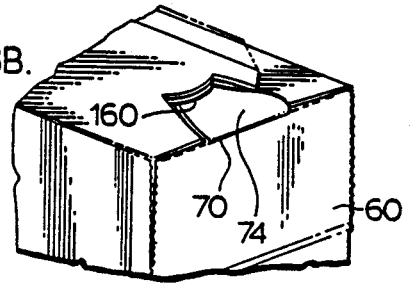
Figure 9D:
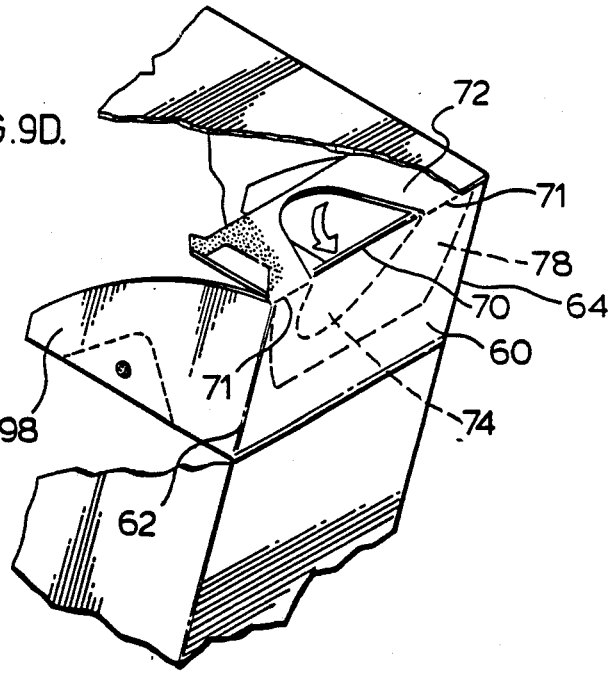
Figure 9E:
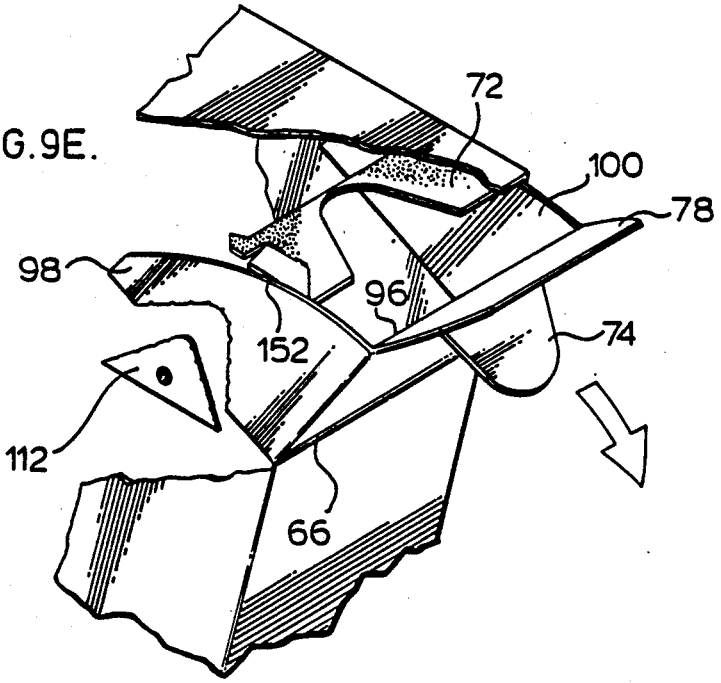

Product now can be poured from the carton 130, confined by the wing panels 98, 100 and guided by the panels 60 and 78 (see FIG. 7A). An efficient spout 156 thereby is provided. An alternative arrangement is shown in FIG. 7B, where a restricted or metered flow only of product is desired, wherein the product is poured through the opening 158 left by detachment of tabs 118, 120.

The extent of opening of the spout 156 is determined by the relative lengths of the curved portions 108 and the flat portions 110 of the contoured periphery of the wing panels 98, 100. In the illustrated embodiment of FIG. 2A, an approximately 55° opening is provided by having the curved portions 108 extend through 55° of arc before the flat portions 110 commence. However, any desired degree of opening may be provided, generally about 40° to about 75°, preferably about 45° to about 60°.

If a, say, 45° opening is employed, as in the embodiment of FIG. 2B then it is possible to provide a greater quantity of material for the glue tab 112 while if a, say 65° opening is employed, then much less of a quantity of material is available for the glue tab. A 45° opening provides larger and stronger side wings for the pouring spout while a 65° opening provides smaller and weaker side wings, with no increase in sheet size being required in either case.

Reclosure of the spout 156 is readily achieved by folding back over the panel 78 and bending panel 60 inwardly about fold line 66 until the fold line 96 is flush with the top edge. During this operation, the contoured periphery of the wing panels 98, 100 rides in the tracks 152, 154. The humped regions 106 of the contoured peripheries provides a good friction lock for the spout in the closed position to guard against accidental opening of the carton 130, even if the carton is accidentally tipped over (see detail of FIG. 8A). The tab 74 then may be pulled to re-open the carton, as access to the contents of the carton 130 is desired. In some instances, the tab 74 may be pushed through the opening 158, which may be provided with convexly-contoured region 160 to overly the adjacent edge of the tab 74, thereby forming a temporary locking feature for more secure closure for seldom-used products (see detail of FIG. 8B).

The carton 130 of the present invention, therefore, is a secure structure when initially formed. The carton 130 is readily produced at high speed using conventional automated carton presses for printing, die-cutting, gluing, and packing by the boxmaker. At the user company level, the completed carton with the integral spout can be readily filled and sealed on conventional high-speed equipment providing ease and economy of usage manufacture. Opening of the carton provides an integral spout 156 formed of the material of construction of the carton, which permits full-width or controlled pouring of product from the corner of the carton with no residual waste.

The spout 156 is specifically designed to provide a readily openable but reclosable structure which reliably delivers product and provides a secure structure when the carton 130 is not in use. This arrangement greatly decreases product contamination, infestation and accidental poisoning of pets and young children.

Elements of the structure ensure that the spout is openable only to a controlled extent, is closeable to a friction-locked enclosure and movement between the fully open and closed structure is guided.

Figure 14:
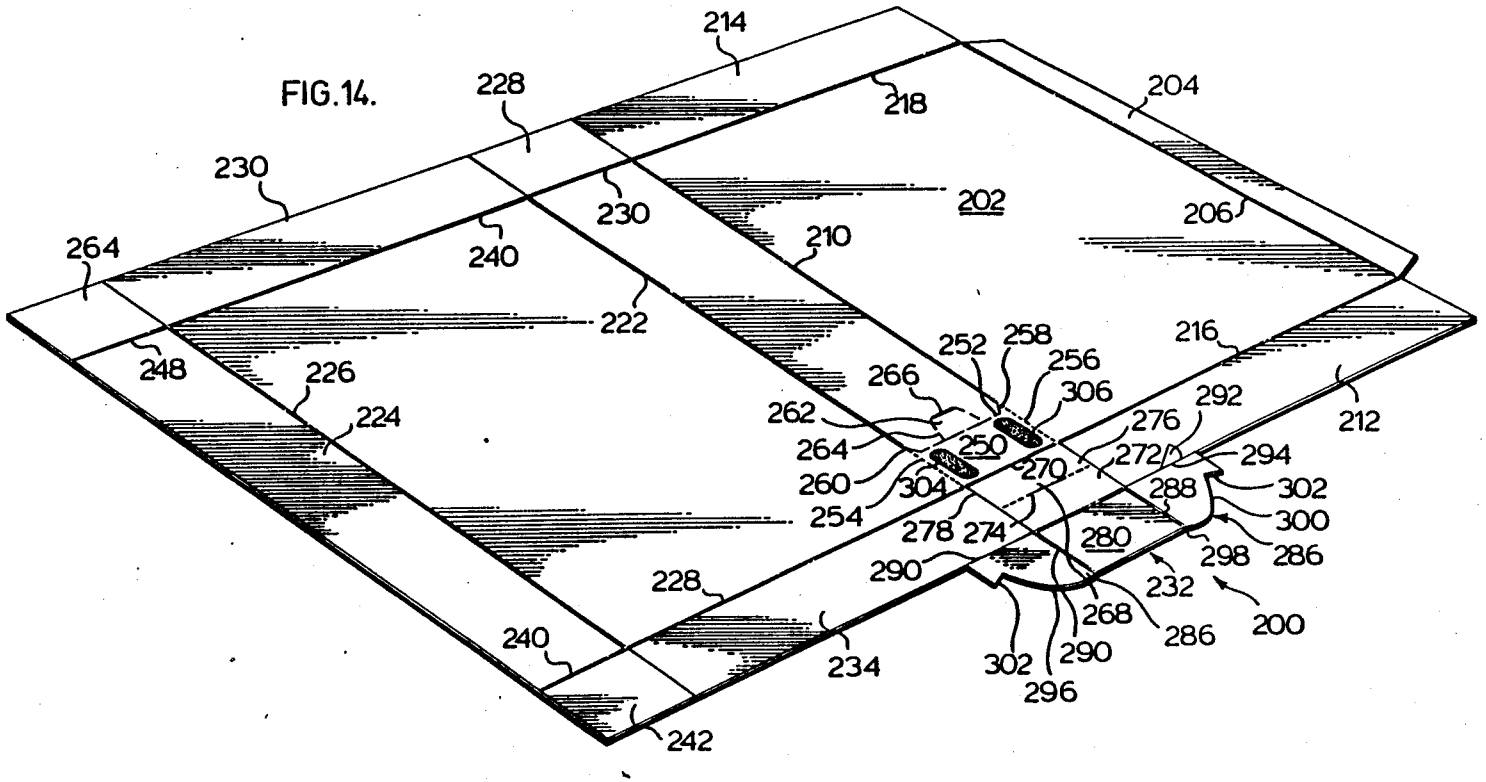
FIG. 14 is a perspective view of a blank for the provision of a carton with a reclosable trough at the bottom of the carton.
Figure 15A:
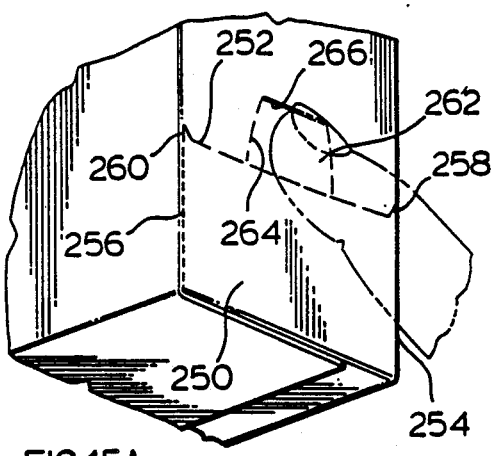
FIGS. 15A, 15B and 15C are perspective and a sectional view illustrating opening of the closure.
Figure 15B:
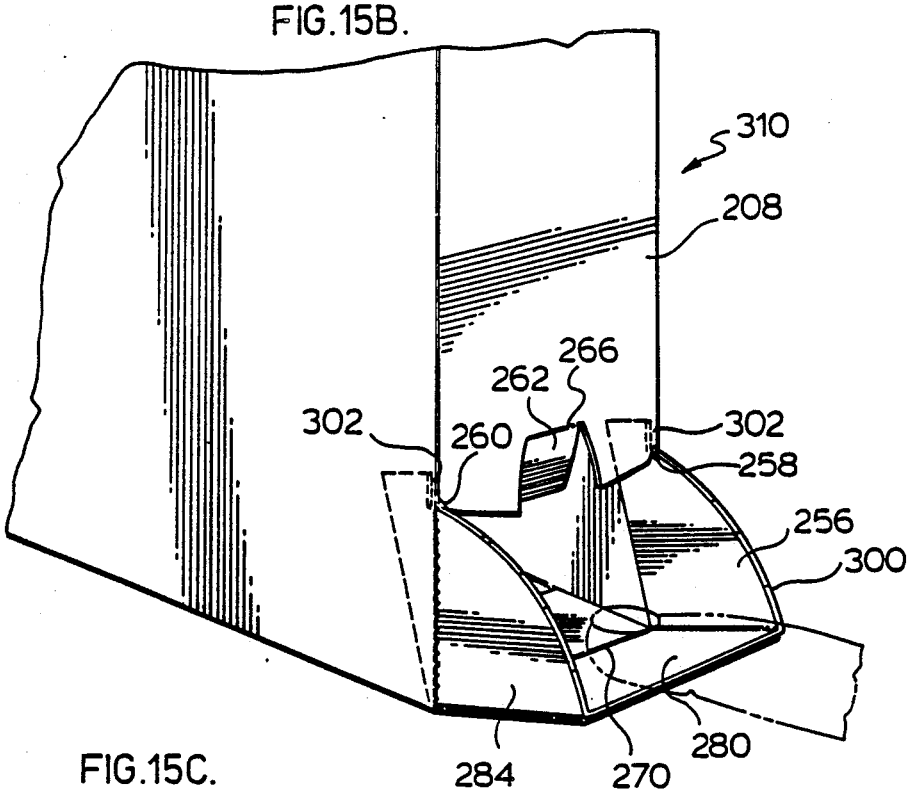
Figure 15C:
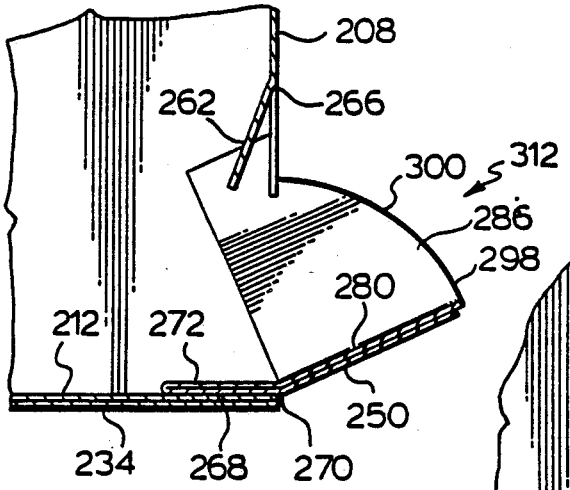
Figure 16:
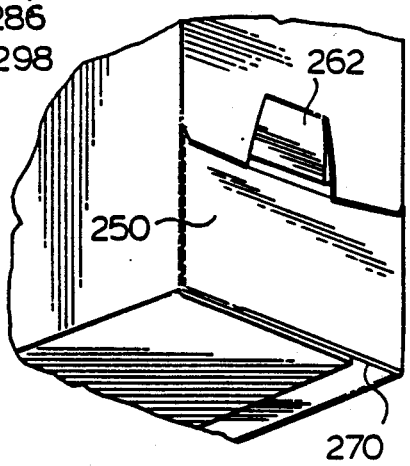
FIG. 16 is a perspective view of the closure in the reclosed position.

Turning now to FIGS. 14 to 16, there is illustrated therein, the application of the principles of the invention to a serving package.

Instead of being located at the top corner of the package, the spout is located at the bottom. With this minor design change, an ideal serving trough is made possible for a growing number of single service type products, many of them in familiar pouch or sachet form. Tea bags, packets of sugar and sugar substitutes, condiments and various medications in pouch form all qualify. Certain types of wrapped candies and lozenges also may benefit from the new one-at-a-time dispenser that is provided.

This new structure opens up unique and superior packaging presentations for all these products. The new carton makes possible a quick dump-fill box for tea bags that can remain on the kitchen cupboard shelf, while the carton is popped open quickly to remove one or two tea bags. This provides new convenience and extends the usefulness and advertising value of the package in the home.

A carton is produced from a blank 200 having a rectangular panel 202 joined at one side edge to a glue lap panel 204 by a fold line 206 and at the other side edge to a panel 208 by a fold line 210. At the top and bottom edges, the panel 202 is joined to panels 212 and 214 respectively by fold line 216, 218.

The panel 208 is joined to a rectangular panel 220 by a fold line 222, which is joined to a panel 224 by a fold line 226. The rectangular panels 202 and 220 are of the same size and form the front and rear panels of the carton, while the panels 208 and 224 form the end panels of the carton.

The panel 208 is joined to a panel 228 by a fold line 230 and to a tab panel 232 from which the closure is formed, as described below. The rectangular panel 220 is joined to panels 234 and 236 by fold lines 238, 240 and panel 224 is joined to panels 242 and 244 by fold lines 246, 248. The panels 212, 232, 234 and 242 combine to provide a bottom end closure to the carton while panels 214, 228, 236 and 244 combine to provide a top closure to the carton.

The tab panel 232 comprises a panel 250 which is joined to the panel 208 by a perforated line 252' and to the panels 202 and 220 by perforated lines 254 and 256. The perforations 254 and 256 are extended inwardly a short distance at 258, 260 to provide a track, as described below.

A tab 262 is provided in the panel 208 with a perforated line outline 264 at its sides and joined to the panel 208 by a fold line 266. The panel 250 is joined to a panel 268 by a fold line 270, while panel 270 in turn is joined to a panel 272 by a fold line 274. The panels 268 and 272, which are of substantially the same dimension, are separated from the panels 212 and 234 by cuts 276, 278.

Panel 272 is joined to a further panel 280 by a fold line 282. The panel 280 is of substantially the same dimensions as panel 250 and has wing panels 284, 286 joined thereto at the side edges by fold lines 288, 290. The wing panels 284, 286 are separated from the panels 212, 234 by cut lines 288, 290. The cut line 288 extends into the panel 212 to form tab 292 which is joined to the wing panel 284 by a perforated line 294.

The wing panels 284 and 286 have a contoured surface 296, including a humped portion 298, a curved portion 300 and a straight portion 302, which acts as stops for the spout, as will become apparent below.

In forming the spout, the tab panel 232 is folded about fold line 274 so that panel 280 overlies panel 250 and panel 272 overlies panel 268. In the process of manufacture, these panels are adhered to each other by glue lines 304, 306 while the tab 292 is adhered to the panel 212 by glue spot 308 to maintain the folded over panels flat during subsequent erection and filling of the carton.

The carton 200 is folded and glued and formed with the spout or trough as a composite part of the package,. The carton then is filled in conventional manner and provides a ready-to-ship sealed carton 310. As seen in FIGS. 15A, 15B and 15C, the spout or trough 312 is opened first by pushing on tab 262 to break the perforations 252 and 264 and to bend the tab inwardly about fold line 266.

A finger or thumb then is inserted into the opening left by the bent away tab 262 and panel 250 is pulled outwardly, causing perforations 252, 254, 256 and 294 to break and then the panel 250 to bend about fold line 270. As the panel 250 moves in this manner, the contoured peripheries 296 of the wing panels 284 and 286 ride in and are guided by the slots formed by perforations 258 and 260.

The outward extremity of movement of the spout 312 is determined by engagement between the flat portions 302 of the contoured peripheries of the wing panels 284, 286 and the internal surface of the end panel 208, as seen particularly in FIGS. 15B and 15C.

Once the spout or trough 312 has been opened in this way, access may be had to the contents of the carton 310 and product may be removed from the carton 310, usually one at a time. The carton 310 is reclosed by pushing panel 250 inwardly to bend about fold line 270 until the panel 250 closes the opening (see FIG. 16). The hump 298 assists in providing a friction lock. The carton 310 is readily reopened and reclosed as required for removal of product from the carton.

In place of the perforated line 252 extending as a straight line across the panel 208, the line may be arced into the panel 208 to provide for more ready access to the product in the resulting carton.

The integral pouring spout of the present invention, described in detail above with respect to FIGS. 1 to 13, overcomes the problems of the prior art and incorporates many useful, beneficial and advantageous design features to the whole train of activity from carton manufacture through the product manufacture and packer to the consumer. These features include the following:

1. Considerable effort has been made to facilitate manual opening of the pouring spout and to protect it from damage during the opening procedure. The consumer simply removes a deeply perforated tab, inserts a thumb through the opening and pulls out the spout. The need for the use of any knife or similar implement in the opening procedure has been eliminated. In so doing, a major liability factor is eliminated and greater convenience and protection is added for the consumer.

2. As the thumb is inserted through the opening left by removal of tabs 118, 120, following flaps 74 and 78 are automatically folded down inside the top edge of .the spout providing a stiffener and anti-tear feature as outward pressure is applied against the spout to break the perforations on the two upper corners of the box. Four thicknesses of paperboard are momentarily provided at the leading edge of the pouring spout and ripping or tearing in this area is almost impossible. Even with, for example, 0.020 inches paperboard, 0.080 inches total thickness is provided and considerable strength in this area results. As a result, the spout opens smoothly and easily without any damage.

3. In general, if it is a struggle, or a complex or time-consuming operation to reclose a package which often is the case with conventional structures, the carton, in many cases simply is left open. A major consumer advantage with the novel design of the invention is the speed and ease of reclosing. The spout closes easily and securely in a split second. Normally, in closing, tab 78 is inserted into the opening and tab 74 is left out to provide an easier "grip feature" to facilitate re-opening of the carton.

4. Even when closed, as indicated above, it is unlikely that any product will escape if the package accidentally tips over on a shelf or within a cupboard.

5. A further design advantage of this invention is the provision of tab 74 which is wider than the opening left by removal of tabs 118, 120 on the top corner of the container. In this way tab 74 provides a bumper or stopping means to prevent the spout from being accidentally pushed into the box interior.

6. An additional design embodiment in tab 74 is that it may also be used as a locking means to secure certain types of products that may be hydroscopic or subject to mold, infestation, etc. Products, such as patching plaster, which are seldom used also can be more securely closed between uses. Tab 74 can simply be folded down into opening and snaps into locking engagement with convex contour 160 adjacent to the opening. This lock automatically disengages upon opening of the spout. A further advantage of this feature is the greater child resistance provided and the appearance that the package has not yet been opened.

7. With the design and positioning of this pouring spout across the full width of the top corner, virtually 100% of the product is dispensed and there is no entrapment in the upper corner such as occurs with metal spouts or other design concepts.

8. If a smaller amount or a finer flow of product is desired, two solutions are provided:

(a) the box may be tipped sideways to pour from the corner of the spout; and (b) two friction features have been built into the spout design that permits opening of the spout from 0° to, say, 55° for controlled product flow; and (c) the spout may be closed but with the opening in the top panel exposed (FIG. 7B).

9. The friction features described above are provided by two design embodiments:

(a) the curvature and design of the two side panels 98,100 of the pouring spout; and (b) the unique design embodiment of providing a horseshoe shaped panel 72 which remains glued up inside the top panel of the carton adjacent to the pouring spout. This panel is calibrated less than the inside diameter of the package and provides a slot or "track" feature in which the side panels of the spout travel as it open and closes. In addition to providing guides for the two wings of the spout, the friction feature also is greatly improved. In addition to this, narrow tabs 82 and 84 are hingedly joined to panel 72 and tend to flex inwardly to further enhance the "track" feature in which the rounded sides of the spout may travel.

10. A further design objective in the provision of panel 72 (which is bonded, during final sealing of the package, to the underside of the major top glue flaps) is the provision of a means for keeping the side panels of the spout from collapsing inwards inside the carton. If this happens, there is a distinct danger that powdered or granular product may leak out in this area and be deflected sideways as the package is tipped to a pouring position. Instead of the product being dispensed into the measuring cup or mixing bowl, it may end up on the floor or table top. This is an area of weakness in other prior art designs and a hazard to commercialization of same.

11. Because of the size and location of the pouring spout there is no annoying clogging of the product during pouring.

12. There are some baking products in smaller sizes where a teaspoon of product may be required. The spout opening is adequate for insertion of the spoon and as it is withdrawn can be levelled off against the top of the opening.

13. The consumer will appreciate that the invention affords a distinct and functional pouring spout for the product, that is easy to use and is unobstructed by panels or flaps that could misdirect or interfere with product flow, in contrast to other prior art concepts.

14. A further annoyance for the consumer arises if a pouring spout is opened and the whole spout dislodges and comes out in your hand. An extremely large flap area on both side walls of the spout is provided in our preferred design which virtually eradicates this problem. A further design function of glue tab 112 (which remains permanently bonded to the inside wa)1 of the carton) is to provide an additional "bumper feature" to further decrease the possibility of the spout being pushed inside the carton upon closure.

15. Every consumer feature and advantage represents a marketing advantage to the user company that totals up to expanding sales and improved market share in a highly competitive marketplace.

16. Because of the rapid, secure closure provided by the invention, excessive moisture or other contaminants are substantially eliminated from the product, especially when compared to many "carved open" gaping packages presently found in the home.

17. Infestation by either insects or rodents is virtually eliminated by the design of the present invention.

18. While no paperboard package can ever be totally child resistant, the inventive design represents a considerable step forward in three respects:

(a) There is no gaping hole in the top of the package inviting entry of a "pre-school" hand;

(b) If a package is accidentally knocked over, there is no resulting pile of product as an open invitation for a young child or family pet to "feed on"; and (c) When the pour spout is fully closed, it is not totally obvious to a pre-schooler where the package opens, but instead is a deterrent since the carton appears to be sealed in its original format.

19. From the point of view of the user company, the inventive design diminishes hazards to the health and greatly decreases the potential for liability claims. This invention in no way inhibits the use of electronic metal detectors on the filling line. This fact alone, is a great boom to consumer protection and decreased liability.

20. The net result of these various features is the provision of a practical, functional pouring spout with many useful features at only a small additional cost to a conventional folding carton with full end seal flaps top and bottom. When compared with the additional cost of metal pouring spouts, a considerable saving is realized by the user company.

The present invention provides a novel carton structure which is, at the same time, practical, functional and economically feasible, quite unlike the prior art proposals as seen in the prior art of which the applicant is aware and cited above. That the present invention provides this unique combination of results is apparent from the following discussion.

A. Practical Considerations

1. A traditional folding carton manufacturer is able to print, die-cut and glue the integral reclosable pouring spout concept of the invention when incorporated into the design of a modified end-seal carton. A number of design features make this entirely feasible on high speed equipment.

The major portion of the pour spout is formed by extending one of the top minor glue laps, as shown for example in FIG. 2B. Tab 78 maybe hingedly joined to panel 60 using a central cut with deep perforations on each side to ensure two objectives, namely (a) accuracy of folding for the pour spout assembly to ensure gluing in the proper location every time, (a crease, for example, is capable of twisting and deflecting to a wide range of locations); (b) Panel 72 and tab 78 are releasably joined together so that, on opening when thumb pressure is applied downwardly on tab 74, the perforations 80 are broken leaving panel 72 securely bonded on the under side of the top, major glue laps adjacent to the spout. Tab 74 remains hingedly joined to the front outer panel 60 of the pouring spout. Tab 78 remains hingedly joined to panel 68 which is the inside front panel of the pour spout, which becomes bonded to the inside of panel 60, using timed glue nozzles on a straight line traditional, high speed gluing machine in the boxmakers plant. The adhesive is applied as shown on panel 60 as spout assembly is picked up and folded back with mechanical fingers on the gluer. No glue is applied to panel 72 or tab 78. At this point, the pouring spout is bonded inside the carton and the traditional glue lap is glued and the carton is folded, sealed and shipped in the usual way to the user company.

2. Because the pouring spout may be subject to damage during traditional die-cutting and stripping operations, provision has been made to allow for automatic stripping of the waste material adjacent to the pouring spout. The carton is die-cut and, at the same instant, the waste in this area is automatically removed and vacuumed away. This, among other considerations, make this invention practical to manufacture and process on high speed equipment in a traditional folding carton plant.

3. Depending on which side of the carton blank that the glue lap is located, one of the side panels 98,100 of the pouring spout is folded over a full 18O ° along the crease which joins it to panel 68. When this happens, upon opening of the carton, one of the side panels of the spout, instead of pressing against the side panel of the carton, it will project out into the interior of the carton at about a 45° angle. When this happens, the panel can interfere with filling heads used in filling the product into the carton. In addition, the panel can seriously interfere with trouble-free opening of the spout. This problem is a weakness of many prior art structures. The present invention encompasses two solutions to this problem.

(a) A micro drop of adhesive may be applied on the carbon blank. This very lightly adheres the one side panel of the spout to the inside major wall of the carton.

(b) The preferred embodiment is to die-cut a small glue tab 112. This is lightly joined by small nicks to the side panel 98 of the spout. Tab 112 then is securely bonded to the inside wall of the carton at 116. When the spout is opened, the perforations 114 give way and the glue tab 112 remains glued in position. The shape and location of the tab is such that it will not jeopardize the strength or function of the side panel 98 of the pouring spout. Also tab 112 provides an additional "stopper means" when the spout is in the closed mode. In addition to the stopper feature, there is a friction locking feature as the peninsula-shaped arm cams over the semi-circular shaped glue tab 112.

4. While the length or depth of the pour spout can vary depending on product flow, carton size etc., the spout is able to open widely, to approximately 50° to 60°, without consuming any additional material. By so doing, the depth of the spout can be decreased to conserve paperboard yet product flow is enhanced as a result.

5. All perforations have been carefully designed and tested so that they will not split open during folding, gluing and shipping of the product. In this regard, about 12 perforations per inch have been found to work best around the outer spout area.

6. Also from a practical standpoint, the carton with the pouring spout must be capable of filling and sealing in the user company's plant, automatically and at high speed. The present invention achieves this result. The structure of the present invention is such that the completed carton with the "built-in spout" looks and performs in substantially the same way as an end-seal carton without the spout. When the carton is squeezed to its open position at the beginning of the filling line, the pour spout does not interfere. The pouring spout, including both side panels, remains firmly against the inside walls of the carton with no interference during filling. In contrast with prior art disclosures, there are no panels or tabs within the carton to interfere with filling heads or free flow of the product upon opening.

7. During the filling procedure, the package of the invention provides for a slightly shorter minor glue lap (panel 72) on the top corner of the carton, adjacent to the pouring spout. However, this minor glue lap has double the thickness and greater strength than a traditional minor glue lap. Tests show that most of the bonding in the area of the minor glue lap takes place within a half-inch of the crease. This is because, under pressure, this flap on conventional cartons deflects downwards inside the carton during the final gluing and closing of the box. Tab 78 provides a "backup panel" to panel 72 and the greater resistance to folding or flexing inwards creates excellent bonding in this area and resistance to sifting etc. There are also two creases instead of just one which increases the spring action and results in better bonding.

8. The two major glue laps on the top of the carton (panels 32,40) are designed to be mirror images of each other. During the final closing and bonding of these top panels, these glue laps are bonded to each other and also to the minor glue laps on each end. In so doing, tabs 118 and 120 on these glue laps are superimposed one upon the other and glue bonded together to become, in effect, a single tab which the consumer tears away in the first step of the opening procedure. This gluing operation is standard in the user company plant but the invention provides a simple, trouble-free access to the pouring spout without the need for knives or instruments of any kind.

9. The present invention also includes the potential manufacture of the pouring spout as a separate piece, either in sheet form or roll form, for application to the inside of the carton blank at the gluing stage which is the final stage of manufacture. The former would be magazine fed and the latter roll fed on the gluer. This embodiment is a potential economy measure only applicable on very large volume production. The remainder of the design features are incorporated into the carton blank, including tabs 118', 120', panel 72' with tab 74' and tabs 82' and 84' as well as the necessary creases and perforations.

10. In order for the present invention to function perfectly the steel rule dies need to be made to perfection and the use of CAD CAM and the Laser system for producing the steel rule dies goes a long way to achieving the desired results (especially on large multiple dies) and a product that functions in a practical fashion for the carton maker, user company and the consumer.

11. There are further practical considerations built into the preferred embodiment of this invention, depending upon the nature of the product to be contained. A tight seal is needed in all areas of the package in the case of powders and fine granular products. Sifting of more granular products such as cat foods, rice, etc., is not generally a problem with traditional end seal cartons and there is less concern about gluing the minor glue laps on both top and bottom.

In all cases, with the present invention, the user company must glue top and bottom major glue laps and also, as a minimum, the one minor glue lap adjacent to the pouring spout. Preferably, all minor glue laps should be glued to produce an improved level of product protection.

Tab 74 is kept clear of glue, but the rest of panel 72 is glued, particularly at the two sides including tabs 82, 84 and adjacent areas thereto. This gluing is provided in order that panel 72 remains glued to the underside of the two top major glue laps.

Four other design options are included in the preferred embodiment when used with powders and fine granular products, namely:

(a) partially die-cut circles or ovals (one or more) can be incorporated into the area of tab 74. These partial die-cuttings are used in this area to provide temporary glue bonding of panel 72 with the inside of the major glue laps. Upon opening by the consumer, the fibers within the oval or circle delaminate from the surface of the board. During shipping and display on the store shelf, this area remains fully sealed and sifting is almost impossible.

(b) To improve sifting problems in the other three corners of the carton, embossments on the minor glue laps may be employed to close and bond the slight gap between the two major glue laps.

(c) Tab 74 in many cases may be printed and varnished, so that traditional resin glue does not adhere and thereby keep it from bonding to the underside of tab 118. This arrangement is the design option for coarser products, where sifting is no problem.

(d) Coatings and laminations of plastic film, foil, etc., also may be used in combination with the pour spout invention for products that are hydroscopic, or where special barrier properties are needed for grease, oils, strong chemicals, etc.

12. A further embodiment of this invention includes provision for the use of the pouring spout in conjunction with products, such as breakfast cereals, that come packaged in a "bag-in-a-box" form of packaging. In order that the pouring spout feature can be successfully used in such a case, this embodiment of the invention includes the provision of an arcuate perforation in the inner bag adjacent to the pouring spout in the upper corner of the box. As the bag is inserted into the box the arcuate shaped flap within the perforation are spot glued with hot melt adhesive to the inner main wall of the pouring spout. Upon opening of the spout the arc shaped flap of the inner bag would be sheared open and the contents ready for pouring. In order for this arrangement to function successfully, the carton needs to be bottom loaded, so that the weight and bulk of the product presses the bag and the adhesive against the main panel of the pouring spout.

A pull open tear strip attached to the bag and projecting into the spout area is also a further possibility. As the box is opened in the prescribed manner, the consumer then would simply pull the brightly colored tear strip, to zip open a generous-sized opening in the top corner of the bag adjacent to the spout.

B. Functional Considerations

1. In order for this invention to function properly for the consumer and the user company, each and every practical and technical consideration already listed contribute together in providing an end product that functions and performs and meets all the major design objectives embodied in a useful and successful product.

2. The many design features listed above also clearly show that this invention functions in a superior way for the consumer especially, but also, for the user company who must fill, store and ship the finished product to all parts of the country.

C. Economic Considerations

Regardless of how good or how unique an invention might be, if no one is prepared to buy it or cannot afford it, it is entirely useless.

Furthermore, in the packaging industry, especially in the high volume commodity market, the equipment used by both the carton suppliers and the user companies is both expensive and very sophisticated. If the package design concept does not function or cannot be made on existing equipment it is also, in most cases, quite useless and an exercise in futility.

Small test production runs on the pouring spout of this invention have already been conducted to make absolutely sure that it can be produced and filled on present day high speed equipment. Design features have been added to facilitate both production and function of this invention.

At the same time steps have been taken to supply the reclosable pouring spout feature at almost no additional cost. This is extremely important in a highly competitive package goods market where volumes are high but profits are low. Carton orders are switched from one supplier to another for a difference in price of 5% or even less.

The design has been made with a view to keeping any up-charges for this added feature down to an absolute minimum. In order to really qualify in this area, the overall sheet size and the number up on the sheet of paperboard must be the same as with the traditional full end-seal carton.

In the preferred embodiment, the length of the end seal panels, both top and bottom, has been cut back by as much as one-half to three-quarters of an inch depending upon the width of the carton. By simple arithmetic, it can be seen that, if the pouring spout projects one and a quarter inches beyond the carton blank and the end seals have been reduced, top and bottom, by five-eighths of an inch, then the overall material consumption for the invention is the same as that used by the conventional full-end seal carton blank.

Board savings, with the escalating cost of paperboard, are becoming more and more of a cost factor. A very high percentage of the cost of the carton is in the paperboard. More important than this, however, is the need to be able to run the same number of cartons on the sheet.

To illustrate, a conventional end-seal carton may currently be running twelve up on the sheet, with close tolerances to the full size of the press. If the sheet size is increased even an inch or two in one direction, it may no longer be possible to run twelve up on the press. One row of cartons would have to be eliminated, reducing the number on the sheet to eight up. This means that the output of that press has been reduced by one-third with drastic dollar penalties on the price of the carton.

There is some latitude also in the depth of the pouring spout, with incremental savings on the material or improved layout on the sheet. The depth may vary from one inch to one and a half inches, depending on carton size and the desired flow of the contents.

As a further saving in material a small portion of the pouring spout may be dove-tailed into the glue laps on the bottom of the adjacent carton on the sheet. If too much is taken away, the integrity of the bottom glue laps would be impaired, upon which rests the whole weight of the contents of the box. In order to facilitate material savings, up to approximately a one-quarter inch encroachment is practical without hazardous results.

In summary, the excellent economic outlook for the packaging innovation provided by the present invention is made possible by three major factors that have been carefully addressed, namely:

(a) material consumption, sheet size and press size for the pouring spout concept is the same, or substantially the same, as a standard full end-seal carton;

(b) apart from a slight slow-down in the gluing procedures, all manufacturing and filling operations in the carton plant and user company plant are virtually the same; and (c) the pouring spout of this design can be opened without the need for a knife or any other instrument. Simple manual opening is made possible, thus eliminating hazards and liability suits.

For these reasons and the sum total of the design embodiments involved contribute together to make an economically feasible and useful invention in todays marketplace.

SUMMARY OF DISCLOSURE

In summary of this disclosure, the present invention provides a novel carton structure which is formed from an integral blank and having an integral pouring spout of particular construction permitting multiple opening and closings. Modifications are possible within the scope of this invention.

What I claim is:

1. In a carton constructed of paperboard material and housing a pourable product to be dispensed therefrom through a pouring spout, the improvement wherein:

said pouring spout is constructed of said paperboard material and is defined by:

a first rectangular panel comprising inner and outer layers and having said inner panel joined to a side panel of said carton by a first fold line extending transversely across the side panel and dimensioned to fill a rectangular opening in said side panel adjacent an upper end thereof through which said product is poured, a first wing panel joined to one side edge of said inner panel of said first rectangular panel by a second fold line, a second wing panel joined to another side edge of said inner panel of said first rectangular panel by a third fold line, each said wing panel extending substantially at right angles to said first rectangular panel into said opening to define first and second side walls of said pouring spout for the entire extent of opening of said spout to a fully-opened position by folding about said first fold line, a tab panel comprising inner and outer layers and joined to an upper edge of said first rectangular panel by a force fold line between the inner panels of the first rectangular panel and the tab panel and a fifth fold line between the outer panels of the first rectangular panel and the tab panel, said tab panel being arranged to be bent between a first position in which said tab panel extends approximately at right angles to said first rectangular panel for entering into said opening when said pouring spout is closed and a second position in which said tab panel permits product to flow over the surface thereof during pouring of product from said carton, and said top panel of said carton having an opening adjacent a joint of said top panel and said side panel which is closed by said tab panel when said pouring spout is closed and which is dimensioned to receive said pull tab means therethrough in interference interlocking relation.

2. The carton of claim 1 wherein said top panel opening is formed by detaching tab means from said top panel during initial opening of said carton and wherein, when said tab means is attached to said top panel and prior to initial opening of said carton, said pull tab means forms part of a second rectangular panel underlying said top panel and adhered thereto except in the region of said pull tab means, said pull tab means being defined by a severable perforated line to permit said pull tab means to become detached from said second rectangular panel during opening of the carton, said tab parallel is substantially coextensive with and underlies but is not adhered to said second rectangular panel, said outer layer of said first rectangular panel is joined to said second rectangular panel except at said fifth fold line by severable perforations to permit said first rectangular panel to become detached from said second rectangular panel except at said fifth fold line, during initial opening of said carton, said outer layer of said first rectangular panel is joined to a front wall and a rear wall of said carton by severable perforations to permit said first rectangular panel to become detached from said front and rear walls during initial opening of said carton.

3. The carton of claim 2 wherein:

said second rectangular panel has side edges which extend substantially parallel to but are spaced inwardly from the adjacent front and rear walls of the carton to define first and second guide means; and said first and second wing panels are dimensioned to be located in and be guided by said first and second guide means during movement of said pouring spout between a fully closed and a fully open position.

4. The carton of claim 3 wherein said wing panels each have a contoured periphery which includes a curved portion which permits guided movement of said pouring spout and a flat portion which prevents further outer movement of said first rectangular panel as said flat portion engages the upper wall of said carton in said guide means.

5. The carton of claim 4 wherein said curved portion extends through about 40 to about 70 degrees of arc.

6. The carton of claim 5 wherein said curved portion extends through about 45 to about 60 degrees of arc.

7. The carton of claim 4 wherein said curved portion of each contoured periphery includes a first hump-like portion adjacent the fold line joining the respective wing panel to the first rectangular panel to frictionally-engage said upper wall of said carton in said guide means when said spout is in its fully closed position.

8. The carton of claim 7 wherein said curved portion of each contoured periphery includes a second hump-like portion adjacent the flat portion to frictionally-engage said upper wall of said carton in said guide means when said spout is in its fully open position.

9. The carton of claim 2 wherein said second rectangular panel and said panel are joined by a perforated line prior to initial opening of the carton to permit said second rectangular panel and said tab panel to become detached from each other during initial opening of said carton.

10. The carton of claim 2 wherein, prior to initial opening of said carton, at least one of said wing panels, a glue tab formed therein by a perforated line which is adhesively joined to an adjacent inner surface of the front or rear wall of the carton, and which becomes detached from the remainder of the wing panel at said perforated line during initial opening of the carton.

11. In a carton constructed of paperboard material and having a product in multiple number of discrete packages to be dispensed therefrom through a spout, the improvement wherein:

said spout is constructed of said paperboard material and is defined by:

a first rectangular panel joined to a bottom panel of said carton by a first fold line and dimensioned to fill a rectangular opening in a side panel adjacent the lower end through which said discrete packages are dispensed, a first wing panel joined to one side edge of said first rectangular panel by a second fold line, and a second wing panel joined to another side edge of said first rectangular panel by a third fold line, each said wing panels extending substantially at right angles to said first rectangular panel into said opening to define first and second side walls of said spout for the entire extent of opening of said spout to a fully opened position by folding about said first fold line, prior to initial opening of the carton;

said first rectangular panel being joined at its sides to front and rear panels of the carton by severable perforation lines and at its upper edge to the side panel of the carton by a severable perforation line, which permits said rectangular panel to become detached from the front, rear and side panels at said perforation lines, and a tab being located in the end panel joined to the first rectangular panel by a severable perforation line, and joined to the end panel by severable perforation lines and by a fold line, to permit, upon initial opening of said carton, the tab to be detached from the first rectangular panel and bent inwardly about said fold line.

12. The carton of claim 11 wherein said first rectangular panel comprises inner and outer layers.

* * * * *